US012338810B1

(12) United States Patent
Chen

(10) Patent No.: US 12,338,810 B1
(45) Date of Patent: Jun. 24, 2025

(54) INFLATION CONTROL SYSTEM HAVING MULTIPLE AIR COMPRESSORS

(71) Applicant: DONGGUAN HESHENG MACHINERY & ELECTRIC CO., LTD., Dongguan (CN)

(72) Inventor: Chi-Wen Chen, New Taipei (TW)

(73) Assignee: DONGGUAN HESHENG MACHINERY & ELECTRIC CO., LTD., Dongguan (CN)

( * ) Notice: Subject to any disclaimer, the term of this patent is extended or adjusted under 35 U.S.C. 154(b) by 26 days.

(21) Appl. No.: 18/432,069

(22) Filed: Feb. 5, 2024

(51) Int. Cl.
*F04B 49/02* (2006.01)
*F04B 41/06* (2006.01)
*F04B 49/06* (2006.01)

(52) U.S. Cl.
CPC ..... *F04B 49/022* (2013.01); *F04B 41/06* (2013.01); *F04B 49/06* (2013.01)

(58) Field of Classification Search
CPC ..... F04B 41/06; F04B 49/02; F04B 49/022; F04B 49/08; F04B 23/04–14
See application file for complete search history.

(56) References Cited

U.S. PATENT DOCUMENTS 4,502,842 A * 3/1985 Currier ..... F04B 49/065 417/63
6,419,454 B1 * 7/2002 Christiansen ..... F04B 49/065 417/4
11,162,492 B2 * 11/2021 Oppel ..... F04C 28/02
12,044,232 B2 * 7/2024 Aoyagi ..... F04B 49/02
2004/0247452 A1 * 12/2004 Sato ..... F04B 49/065 417/53
2006/0216159 A1 * 9/2006 Raghavachari ..... F04B 41/00 417/279
2007/0077151 A1 * 4/2007 Hirasawa ..... F04B 49/022 417/5

(Continued)

FOREIGN PATENT DOCUMENTS

CN 105697349 A * 6/2016 ..... F04B 49/06
CN 221742828 U * 9/2024
JP 4924855 B1 * 4/2012 ..... F04B 41/06

*Primary Examiner* — Laert Dounis
(74) *Attorney, Agent, or Firm* — Leong C. Lei

(57) ABSTRACT

The inflation control system includes low-pressure and high-pressure air compressors, an electronic pressure control module, and an air manifold element. The electronic pressure control module is electrically connected to the low-pressure and high-pressure air compressors separately, and monitors an air pressure value of a to-be-inflated object. The air manifold element collects and outputs air from the low-pressure and high-pressure air compressors to the to-be-inflated object. When the air pressure value monitored by the electronic pressure control module is lower than a preset pressure threshold, the electronic pressure control module simultaneously controls the low-pressure and high-pressure air compressors to inflate the to-be-inflated object. When the air pressure value monitored by the electronic pressure control module is higher than the preset pressure threshold, the electronic pressure control module stops the low-pressure air compressor and controls the high-pressure air compressor to continue inflation until an inflation set value is reached.

10 Claims, 4 Drawing Sheets

(56) References Cited

U.S. PATENT DOCUMENTS

| | | | | |
|---|---|---|---|---|
| 2014/0140813 | A1* | 5/2014 | Ochi | F04D 13/12<br>415/13 |
| 2015/0370265 | A1* | 12/2015 | Ren | F04C 14/02<br>137/565.29 |
| 2016/0201665 | A1* | 7/2016 | Hirata | F04B 49/022<br>417/278 |

* cited by examiner

INFLATION CONTROL SYSTEM HAVING MULTIPLE AIR COMPRESSORS

BACKGROUND OF THE INVENTION

(a) Technical Field of the Invention

The present invention generally relates to air compressors, and more particularly to an inflation control system having multiple air compressors.

(b) Description of the Prior Art

Air compressors are primarily used for pneumatic tools or various inflatable devices, serving as a source of pressurized air. In addition to becoming a necessary tool for workplaces or general household repairs, an air compressor is also a primary equipment for inflating automotive tires.

However, in the pursuit of optimal inflation efficiency, some manufacturers have developed inflation devices with multiple sets of air compressors. For example, within one inflation device, there are at least two or more low-pressure air compressors. By simultaneously outputting air from two low-pressure air compressors and inflating an object, this effectively enhances inflation efficiency, reducing the required inflation time. However, inflation devices with dual low-pressure air compressors can only inflate low-pressure objects (such as balls or bicycle tires) and cannot inflate high-pressure objects (such as truck or heavy-duty trailer tires).

To achieve the best inflation efficiency for high-pressure objects, manufacturers have developed inflation devices with multiple sets of high-pressure air compressors. For instance, within one inflation device, there are at least two or more high-pressure air compressors. By simultaneously outputting air from two high-pressure air compressors and inflating an object, this not only improves inflation efficiency but also allows for the inflation of high-pressure objects. However, the installation of multiple sets of high-pressure air compressors in an inflation device, while suitable for high-pressure inflation, slightly extends the inflation time and inevitably increases the overall production cost, leading to a relatively higher final selling price, which may not align with market needs.

SUMMARY OF THE INVENTION

The present invention teaches an inflation control system including at least a low-pressure air compressor, at least a high-pressure air compressor, an electronic pressure control module, and an air manifold element. The low-pressure air compressor has at least an air outlet connecting a first air supply pipe. The high-pressure air compressor has at least an air outlet connecting a second air supply pipe. The electronic pressure control module is electrically connected to the low-pressure air compressor and high-pressure air compressor separately to control their turning on and off. The electronic pressure control module monitors an air pressure value of a to-be-inflated object, and the electronic pressure control module has a preset pressure threshold. The air manifold element has multiple input ports and an output port. The input ports are respectively connected to the first air supply pipe and the second air supply pipe. The air manifold element thereby collects and outputs air from the low-pressure air compressor and the high-pressure air compressor to the to-be-inflated object.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
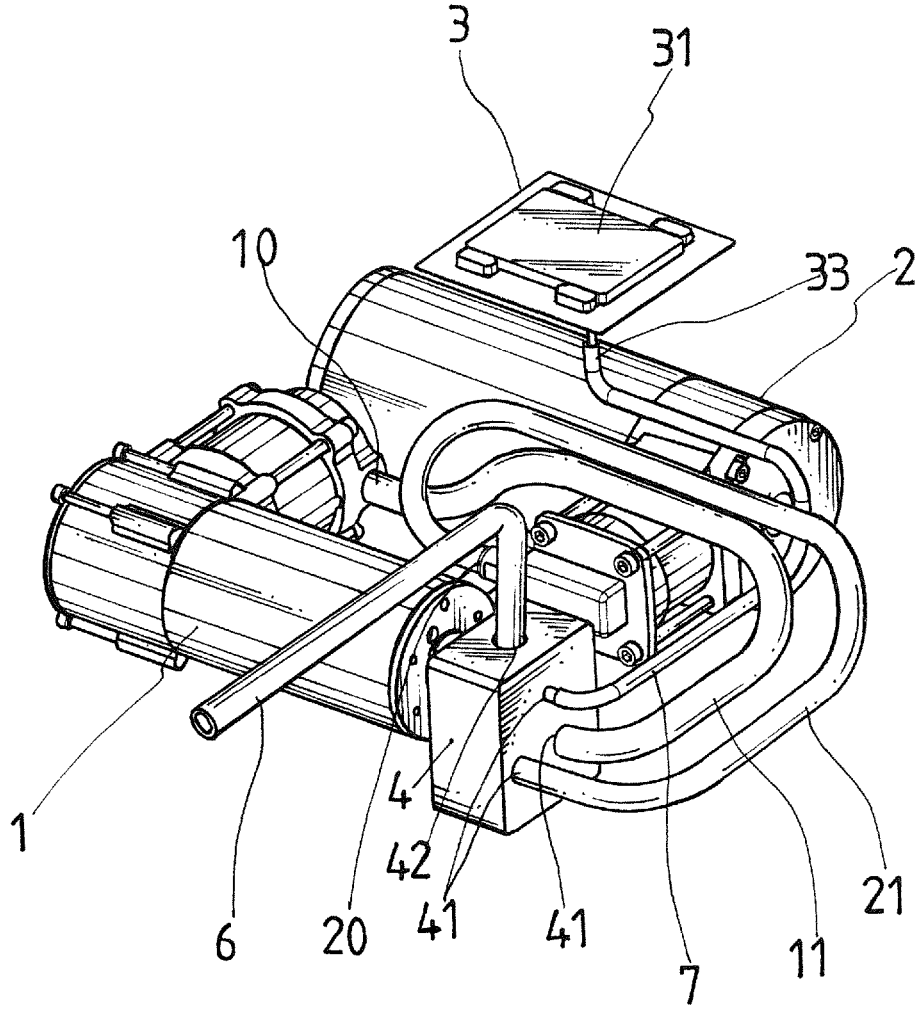
FIG. 1 is a perspective diagram showing an inflation control system according to a first embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 4, an inflation control system according to the present invention includes at least a low-pressure air compressor 1, at least a high-pressure air compressor 2, an electronic pressure control module 3, and an air manifold element 4. The low-pressure air compressor 1 is equipped with at least one air outlet 10, and connected to the air outlet 10 is a first air supply pipe 11. The low-pressure air compressor 1 has a motor of a smaller power and a larger cylinder diameter, allowing it to be used for inflating objects with low-pressure requirements (such as objects with inflation pressure ranging from 1 to 50 PSI). The detailed internal structure of the low-pressure air compressor 1 is not a technical feature of the present invention and will not be further elaborated here.

The high-pressure air compressor 2 is equipped with at least one air outlet 20, and connected to the air outlet 20 is a second air supply pipe 21. The high-pressure air compressor 2 has a motor of a larger power and a smaller cylinder diameter, compared to the low-pressure compressor 1. These allow the high-pressure compressor 2 to be used for inflating objects with low-pressure requirements (such as objects with inflation pressure less than 50 PSI) and objects with high-pressure requirements (such as objects with inflation pressure greater than 50 PSI). The detailed internal structure of the high-pressure air compressor 2 is not a technical feature of the present invention and will not in be further elaborated here.

The cylinder diameter of the low-pressure air compressor 1 is larger than that of the high-pressure air compressor 2, and their motors can be of the same or different specifications.

The electronic pressure control module 3 is electrically connected to the low-pressure air compressor 1 and high-pressure air compressor 2 separately to control the operation of the low-pressure air compressor 1 and the high-pressure air compressor 2. For example, the electronic pressure control module 3 is electrically connected to the motor of the low-pressure air compressor 1 and the motor of the high-pressure air compressor 2, controlling the operation of the motor of the low-pressure air compressor 1 and the motor of the high-pressure air compressor 2. The electronic pressure control module 3 can monitor the pressure value at the inflation end, and the electronic pressure control module 3 can have a preset pressure threshold. When the pressure value monitored by the electronic pressure control module 3 at the inflation end is lower than the preset pressure threshold, the electronic pressure control module 3 simultaneously controls the low-pressure air compressor 1 and the high-pressure air compressor 2 to start the inflation operation. Furthermore, when the pressure value monitored by the electronic pressure control module 3 at the inflation end is higher than the preset pressure threshold, the electronic pressure control module 3 controls the low-pressure air compressor 1 to stop the inflation operation and controls the high-pressure air compressor 2 to continue the inflation operation.

The air manifold element 4 is equipped with multiple input ports 41 and one output port 42. The multiple input ports 41 are respectively connected to the first air supply pipe 11 of the low-pressure air compressor 1 and the second air supply pipe 21 of the high-pressure air compressor 2. The output port 42 can be connected to a third air supply pipe 6, allowing the air manifold element 4 to collect the air output from the low-pressure air compressor 1 and the high-pressure air compressor 2. The collected air is then output through the output port 42 via the third air supply pipe 6 to inflate a to-be-inflated object 5 or, alternatively, to an externally inflatable object.

Figure 2:
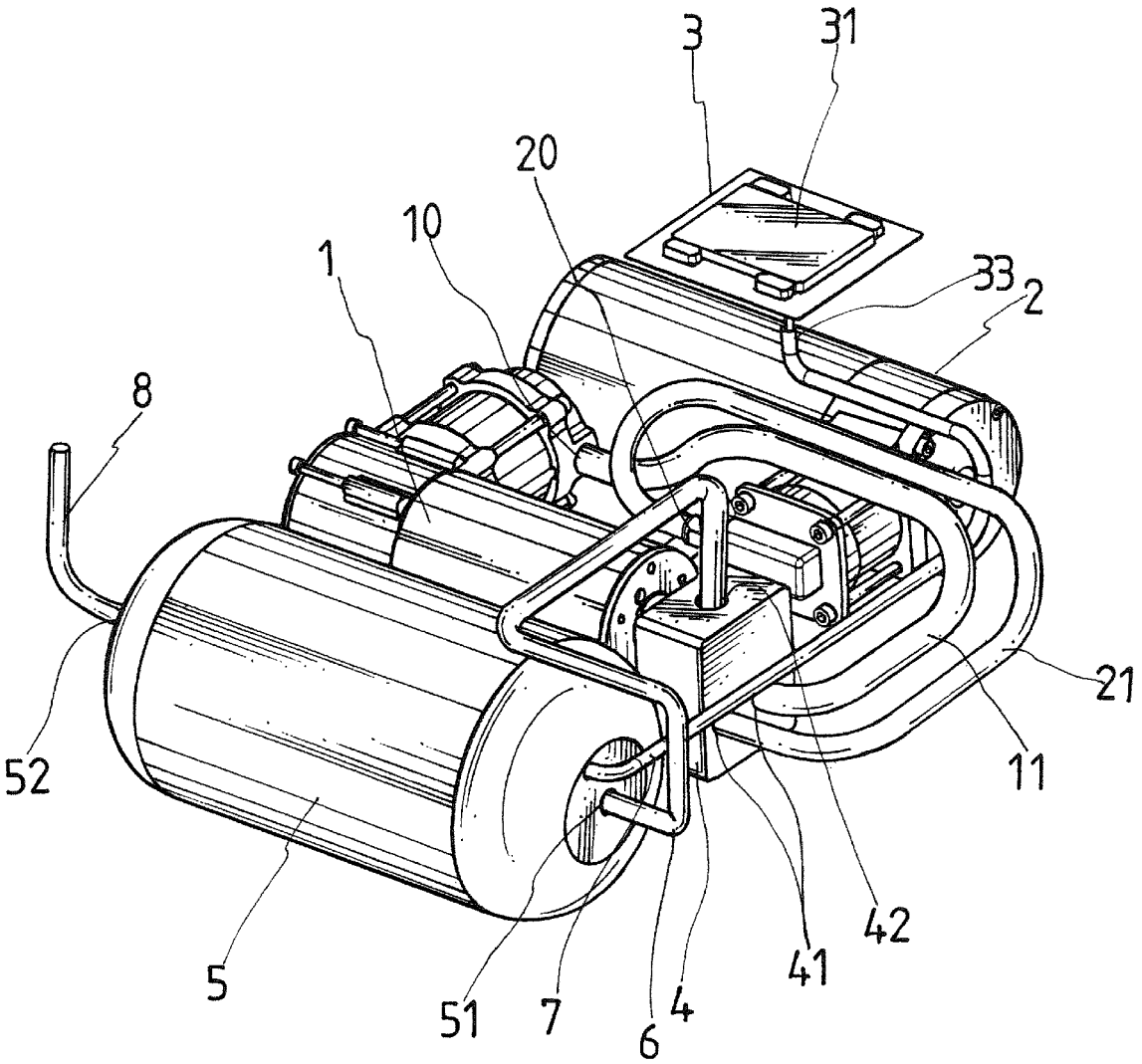
FIG. 2 is a perspective diagram showing an inflation control system according to a second embodiment of the present invention.
Figure 3:
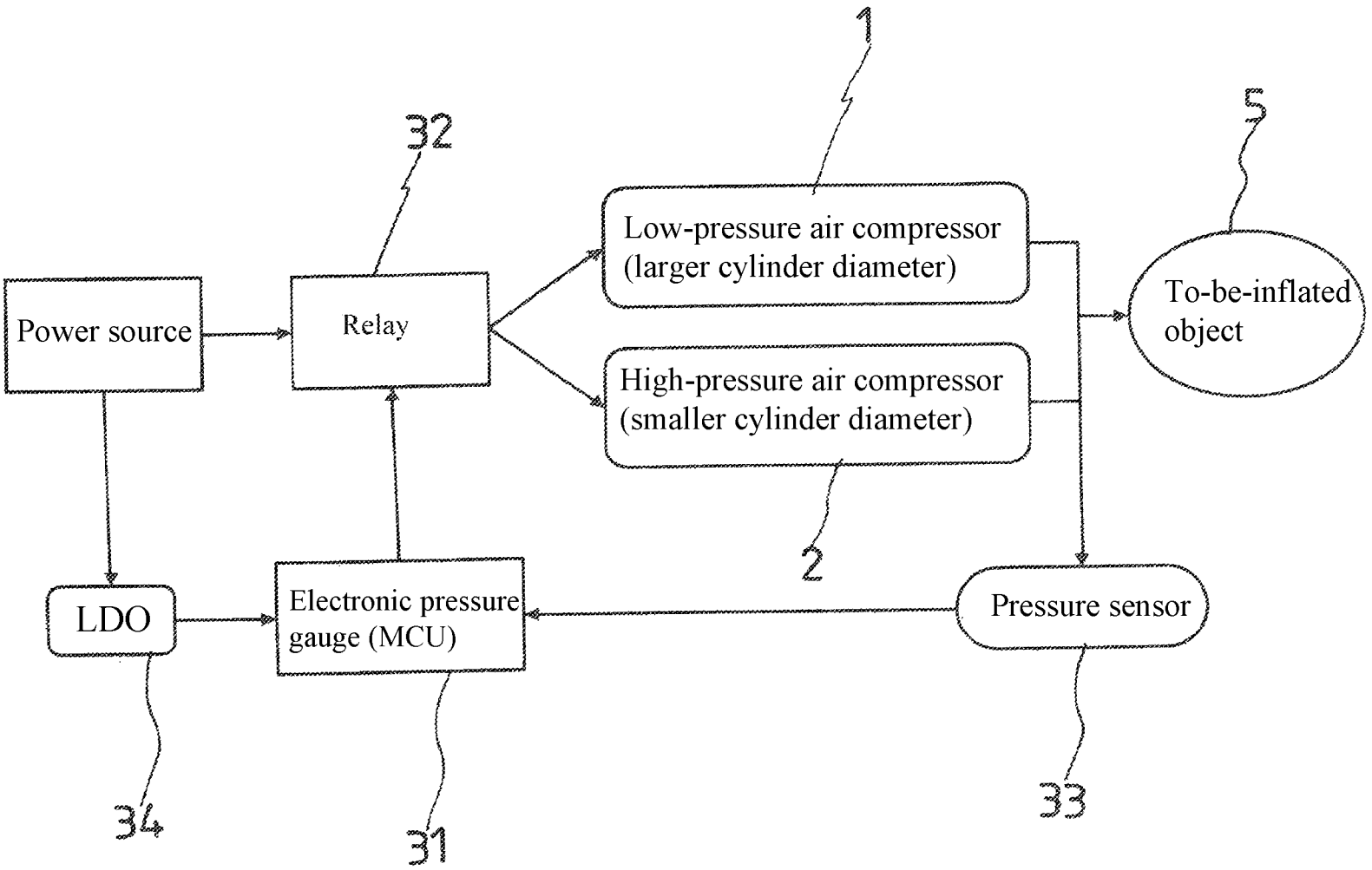
FIG. 3 is a functional block diagram showing the inflation control system of the present invention.

The electronic pressure control module 3 includes an electronic pressure gauge 31, a relay 32, a pressure sensor 33, and a low-dropout regulator (LDO) 34; the electronic pressure gauge 31 can be a microcontroller unit (MCU) used for processing, detecting, and displaying air pressure signals. It can also serve as a control and processing unit for turning power on or off. The electronic pressure gauge 31 is configured with the preset pressure threshold. The relay 32 is electrically connected to the electronic pressure gauge 31, the motor of the low-pressure air compressor 1, and the motor of the high-pressure air compressor 2. The pressure sensor 33 is electrically connected to the electronic pressure gauge 31, and the pressure sensor 33 can be connected to a fourth air supply pipe 7, which is then connected to one of the input ports 41 of the air manifold element 4 (as shown in FIG. 1) or connected to the to-be-inflated object 5 (as shown in FIG. 2). This allows the pressure sensor 33 to detect the air pressure value at the end of the to-be-inflated object 5 and transmit the detected air pressure value signal to the electronic pressure gauge 31 for signal processing. Furthermore, the input of the electronic pressure gauge 31 is also electrically connected to the low-dropout regulator 34 (LDO), serving as a stable DC voltage power supply for the electronic pressure gauge 31. When the electronic pressure control module 3 is connected to an external power source and activated, the electronic pressure gauge 31 controls the startup or shutdown of the motors of the low-pressure air compressor 1 and high-pressure air compressor 2 separately through the relay 32. The pressure sensor 33 detects the air pressure value at the end of the to-be-inflated object 5, and the detected air pressure value signal is transmitted to the electronic pressure gauge 31. The electronic pressure gauge 31 compares and judges the air pressure value with the preset pressure threshold.

The electronic pressure gauge 31 can be configured with an inflation set value. When the pressure sensor 33 monitors the air pressure value at the end of the to-be-inflated object 5 and it equals (or reaches) the inflation set value, the electronic pressure gauge 31, through relay 32, independently shuts down the motors of the low-pressure air compressor 1 and the high-pressure air compressor 2, thereby stopping the inflation process.

As shown in FIG. 2, the to-be-inflated object 5 is equipped with at least one intake end 51 and at least one exhaust end 52. The third air supply pipe 6 of the air manifold element 4, connected to the output port 42, can be linked to the intake end 51 of the to-be-inflated object 5. Additionally, the fourth air supply pipe 7 of the pressure sensor 33 is also connected to the to-be-inflated object 5. Furthermore, the exhaust end 52 of the to-be-inflated object 5 is connected to a fifth air supply pipe 8, which is used to release the internal air from the to-be-inflated object 5, which can be a pressure storage tank.

In summary, when the electronic pressure control module 3 monitors the air pressure value of the to-be-inflated object 5 (such as an air storage pressure tank, tire, ball, inflatable bed, pad, etc.) and finds it to be lower than the preset pressure threshold, the to-be-inflated object 5 is in a low-pressure state. At this point, the electronic pressure control module 3 separately controls the low-pressure air compressor 1 and the high-pressure air compressor 2 to simultaneously start inflation. This is done by inflating the to-be-inflated object 5 in a manner that combines the flow rates from both air compressors, effectively improving inflation efficiency and reducing the required inflation time. When the electronic pressure control module 3 monitors the air pressure value at the end of the to-be-inflated object 5 and finds it to be higher than the pressure threshold, the to-be-inflated object 5 is in a high-pressure state. The electronic pressure control module 3 then controls the low-pressure air compressor 1 to shut down and stop inflation, while controlling the high-pressure air compressor 2 to remain open for continuous inflation. This approach involves high-pressure inflation of the to-be-inflated object 5, eliminating the need for two high-pressure, high-flow air compressors. As a result, it effectively reduces the overall cost of the inflation control system.

Figure 4:
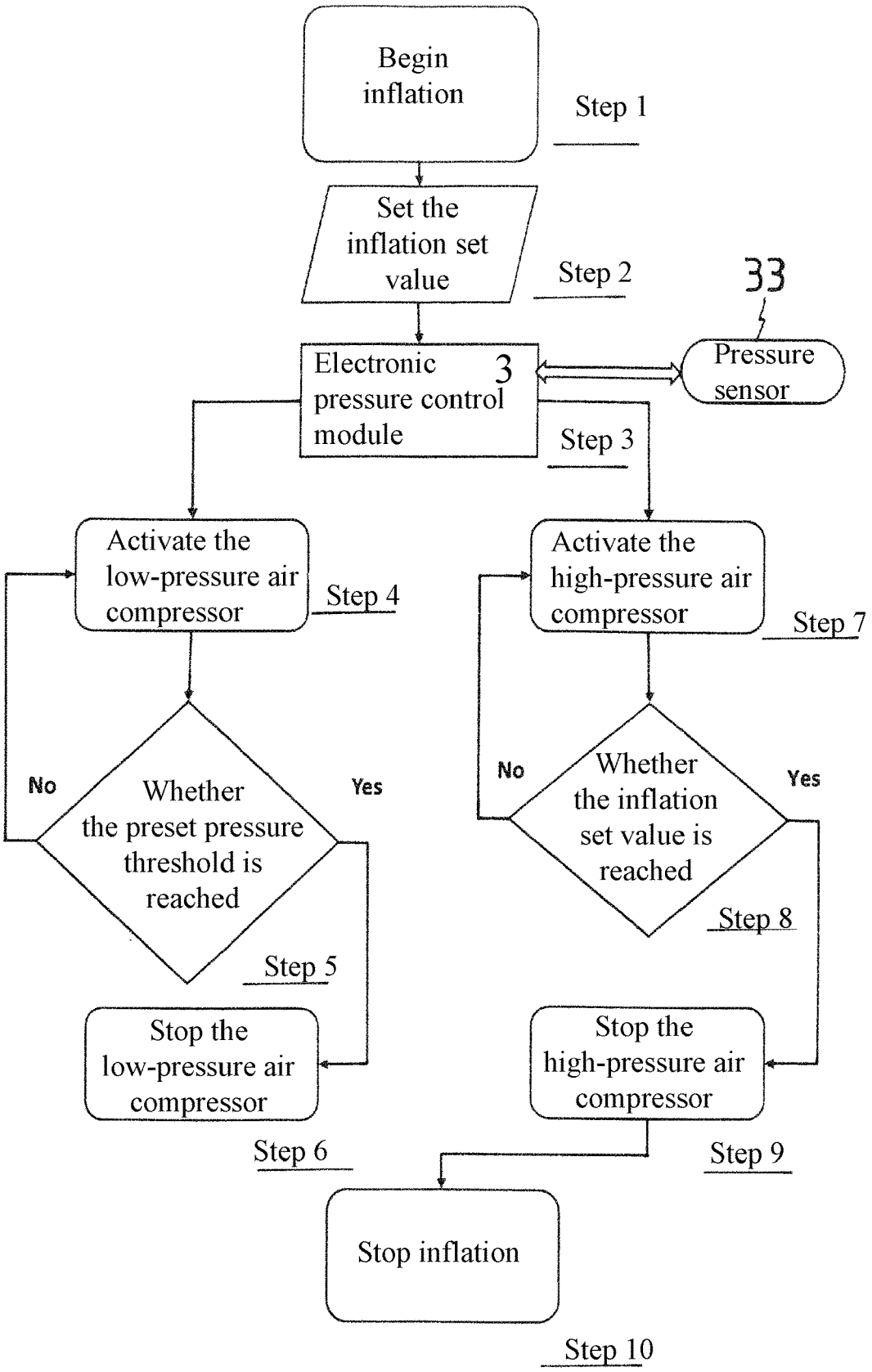
FIG. 4 is a flow diagram showing an operation process of the inflation control system of the present invention.

As shown in FIG. 4, the inflation control system of the present invention is operated as follows.

Step 1: Begin inflation and proceed to Step 2.

Step 2: Set the inflation set value for the electronic pressure gauge 31 of the electronic pressure control module 3. For example, set the inflation set value to 100 PSI, while the default pressure threshold of the electronic pressure gauge 31 is 50 PSI.

Step 3: Activate and control the low-pressure air compressor 1 and high-pressure air compressor 2 using the electronic pressure gauge 31. This involves executing Steps 4 and 7.

Step 4: Execute Step 5.

Step 5: If the air pressure value of the to-be-inflated object 5 is less than the preset pressure threshold, repeat Step 4. If the air pressure value is greater than the preset pressure threshold, proceed to Step 6.

Step 6: Stop the low-pressure air compressor 1.

Step 7: Execute Step 8.

Step 8: If the air pressure value of the to-be-inflated object 5 is less than the inflation set value, repeat Step 7. If the air pressure value equals or reaches the inflation set value, proceed to Step 9.

Step 9: Stop the high-pressure air compressor 2 and proceed to Step 10.

Step 10: Stop inflation.

Therefore, the technical features of the present invention lie in the inflation control system is equipped with at least one low-pressure air compressor 1 and at least one high-pressure air compressor 2. The system utilizes the electronic pressure control module 3 to monitor the air pressure value of the to-be-inflated object 5, along with a preset pressure threshold. When the electronic pressure control module 3 observes that the air pressure value of the to-be-inflated object 5 is below the pressure threshold, indicating that the to-be-inflated object 5 is in a low-pressure state, the electronic pressure control module 3 separately controls the low-pressure air compressor 1 and the high-pressure air compressor 2 to simultaneously start inflation.

In other words, the present invention inflates the to-be-inflated object 5 in a manner that combines the flow rates from two air compressors, effectively improving inflation efficiency, and thereby reducing the time required for inflation. Additionally, when the electronic pressure control module 3 monitors the air pressure value of the to-be-inflated object 5 and finds it to be higher than the pressure threshold, indicating that the to-be-inflated object 5 is in a high-pressure state, the electronic pressure control module 3 controls the low-pressure air compressor 1 to shut down and stop inflation while controlling the high-pressure air compressor 2 to remain open for continuous inflation. This achieves high-pressure inflation of the to-be-inflated object 5 without the need for two high-pressure, high-flow air compressors, effectively reducing the overall cost of the inflation control system.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. An inflation control system, comprising:

a low-pressure air compressor having an air outlet connecting a first air supply pipe;

a high-pressure air compressor having an air outlet connecting a second air supply pipe;

an electronic pressure control module electrically connected to the low-pressure air compressor and high-pressure air compressor separately to control their turning on and off, where the electronic pressure control module monitors an air pressure value of a to-be-inflated object, and the electronic pressure control module has a preset pressure threshold; and an air manifold element having a plurality of input ports and an output port, where the input ports are respectively connected to the first air supply pipe and the second air supply pipe, and the air manifold element thereby collects and outputs air from the low-pressure air compressor and the high-pressure air compressor to the to-be-inflated object;

wherein, when the air pressure value monitored by the electronic pressure control module is lower than the preset pressure threshold, the electronic pressure control module simultaneously controls the low-pressure air compressor and the high-pressure air compressor to inflate the to-be-inflated object; and, when the air pressure value monitored by the electronic pressure control module is higher than the preset pressure threshold, the electronic pressure control module stops the low-pressure air compressor and controls the high-pressure air compressor to continue inflation.

2. The inflation control system according to claim 1, wherein the electronic pressure control module comprises an electronic pressure gauge, a relay, and a pressure sensor; the electronic pressure gauge processes, detects, and displays air pressure signals, and serves as a control and processing unit for turning power on or off; the electronic pressure gauge is configured with the preset pressure threshold and an inflation set value; the relay is electrically connected to the electronic pressure gauge, a motor of the low-pressure air compressor, and a motor of the high-pressure air compressor; the pressure sensor is electrically connected to the electronic pressure gauge; and the pressure sensor detects the air pressure value of the to-be-inflated object, and transmit detected air pressure value to the electronic pressure gauge for signal processing.

3. The inflation control system according to claim 2, wherein the electronic pressure control module further comprises a low-dropout regulator electrically connected to the electronic pressure gauge, serving as a stable DC voltage power supply for the electronic pressure gauge.

4. The inflation control system according to claim 2, wherein the pressure sensor is connected to a fourth air supply pipe, which is connected to one of the input ports of the air manifold element.

5. The inflation control system according to claim 2, further comprises the to-be-inflated object having an intake end and an exhaust end; the pressure sensor is connected to a fourth air supply pipe, which is connected to the to-be-inflated object; the output port of the air manifold element is connected to a third air supply pipe, which is connected to the intake end of the to-be-inflated object.

6. The inflation control system according to claim 5, wherein the exhaust end of the to-be-inflated object is connected to a fifth air supply pipe, which is used to release air from the to-be-inflated object.

7. The inflation control system according to claim 6, wherein the to-be-inflated object is a pressure storage tank.

8. The inflation control system according to claim 1, wherein the output port of the air manifold element is connected to a third air supply pipe, allowing the air manifold element outputs air collectively from the low-pressure air compressor and the high-pressure air compressor to the to-be-inflated object.

9. The inflation control system according to claim 1, wherein the low-pressure and high-pressure air compressors comprise cylinders, respectively; and a diameter of the cylinder of the low-pressure air compressor is larger than that of the high-pressure air compressor.

10. The inflation control system according to claim 9, further comprising a motor for each of the low-pressure and high-pressure air compressors, wherein the motors of the low-pressure and high-pressure air compressors are of the same or different specifications.

* * * * *